US006619251B2

(12) United States Patent
Kobayashi et al.

(10) Patent No.: US 6,619,251 B2
(45) Date of Patent: Sep. 16, 2003

(54) TAPPET FOR AN INTERNAL COMBUSTION ENGINE

(75) Inventors: Haruki Kobayashi, Fujisawa (JP); Junichi Fukuda, Fujisawa (JP)

(73) Assignee: Fuji Oozx Inc. (JP)

( * ) Notice: Subject to any disclaimer, the term of this patent is extended or adjusted under 35 U.S.C. 154(b) by 0 days.

(21) Appl. No.: 10/225,703

(22) Filed: Aug. 22, 2002

(65) Prior Publication Data

US 2003/0041825 A1 Mar. 6, 2003

(30) Foreign Application Priority Data

Aug. 29, 2001 (JP) ..... 2001-259776

(51) Int. Cl.[7] ..... F01M 1/06

(52) U.S. Cl. ..... 123/90.35; 123/90.48; 123/90.55

(58) Field of Search ..... 123/90.35, 90.48, 123/90.51, 90.49, 90.55–90.58

(56) References Cited

U.S. PATENT DOCUMENTS

| | | | | | |
|---|---|---|---|---|---|
| 4,430,970 | A | * | 2/1984 | Holtzberg et al. | 123/90.51 |
| 5,007,388 | A | * | 4/1991 | Seilenbinder | 123/90.55 |
| 5,237,967 | A | * | 8/1993 | Willermet et al. | 123/90.51 |
| 5,921,210 | A | * | 7/1999 | Regueiro | 123/90.22 |
| 5,934,236 | A | * | 8/1999 | Rao et al. | 123/90.51 |
| 6,089,200 | A | * | 7/2000 | Speil et al. | 123/90.55 |
| 6,397,806 | B2 | * | 6/2002 | Imai et al. | 123/90.48 |

* cited by examiner

*Primary Examiner*—Thomas Denion
*Assistant Examiner*—Kyle Riddle

(57) ABSTRACT

A tappet is used in a valve-operating mechanism of an internal combustion engine. The tappet has a top wall and the upper surface of the top wall is engaged with a cam. The lower surface is engaged on a poppet valve which moves up and down. A downward projection which has a recess for storing lubricating oil is formed in the middle of the lower surface of the top wall of the tappet, thereby lubricating interfaces with the cam or valve to improve frictional or wear resistance.

2 Claims, 4 Drawing Sheets

TAPPET FOR AN INTERNAL COMBUSTION ENGINE

BACKGROUND OF THE INVENTION

The present invention relates to a tappet used in a direct-acting valve operating mechanism to decrease frictional resistance with a cam.

In a direct-acting valve operating mechanism of an internal combustion engine, various tappets are used, such as a cylindrical steel tappet and a cylindrical Al tappet which has a bore on the upper surface with which a metal shim is engaged.

Recently, in view of preservation of earth environment, control of exhaustion of $CO_2$ has become strict. In automobiles, it is strongly required to improve fuel economy.

To improve fuel economy in automobiles, mechanical loss of an engine, especially friction loss in a valve-operating mechanism, may be preferably decreased as much as possible.

In a direct-acting valve operating mechanism in which the upper surface of a tappet is pressed by rotation of a cam to drive a poppet valve directly, sliding frictional resistance between the upper surface of a tappet and a cam in low- and middle-rotation-speed range becomes larger. To decrease frictional resistance, it is preferable to lubricate the interface between the upper surface of a tappet and a cam, but in a conventional tappet, the upper surface is formed as flat to decrease oil-storage properties of lubricating oil, so that it is difficult to decrease frictional resistance.

In particular, in a V-type engine in which an axis of a tappet is inclined, oil-storage properties of lubricating oil on the upper surface of a tappet is further decreased to increase frictional resistance with the cam, so that wear with the interface is increased.

A known steel tappet is heavy, which decreases output and fuel economy. A known Al tappet is light, but is expensive in manufacturing.

SUMMARY OF THE INVENTION

In view of the disadvantages, it is an object of the invention to provide a tappet for an internal combustion engine, the tappet being light and inexpensive to lubricate the upper surface of a top wall effectively and decrease frictional resistance with a cam.

According to the present invention, to achieve the object, there is provided a tappet for an internal combustion engine, comprising:

a top wall which is engaged with a cam; and a cylindrical portion into which a poppet valve is inserted, a downward projection being formed in the middle of the lower surface of the top wall and having an oil-storage recess on the upper surface, diameter of the projection being smaller of width of the cam.

By the lubricating oil stored in the recess, frictional or wear resistance is improved between a cam and the upper surface of the tappet, and/or between the lower surface of the projection and the upper end of a poppet valve which moves up and down.

BRIEF DESCRIPTION OF THE DRAWINGS

The features and advantages of the invention will become more apparent from the following description with respect to embodiments as shown in appended drawings wherein.

DETAILED DESCRIPTION OF PREFERRED EMBODIMENTS

Embodiments of the present invention will be described with respect to the appended drawings.

Figure 1:
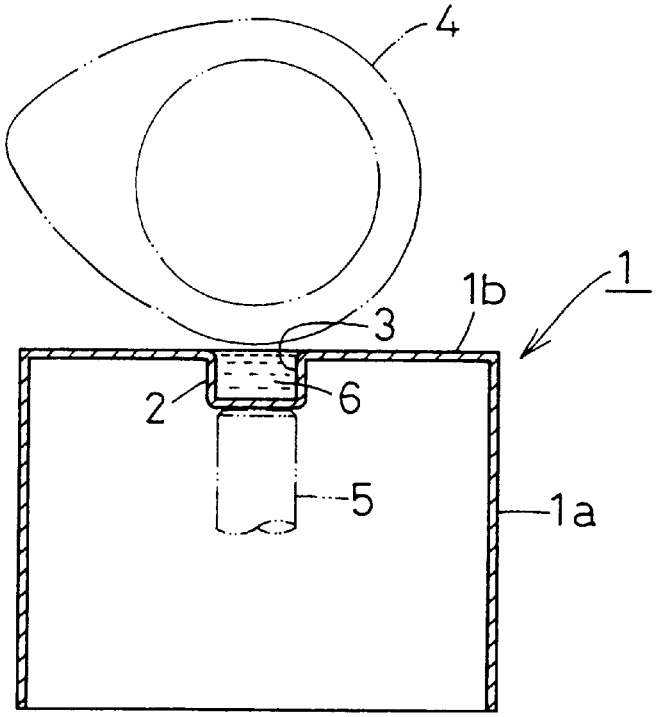
FIG. 1 is a central vertical sectional front view of the first embodiment of a tappet according to the present invention.
Figure 2:
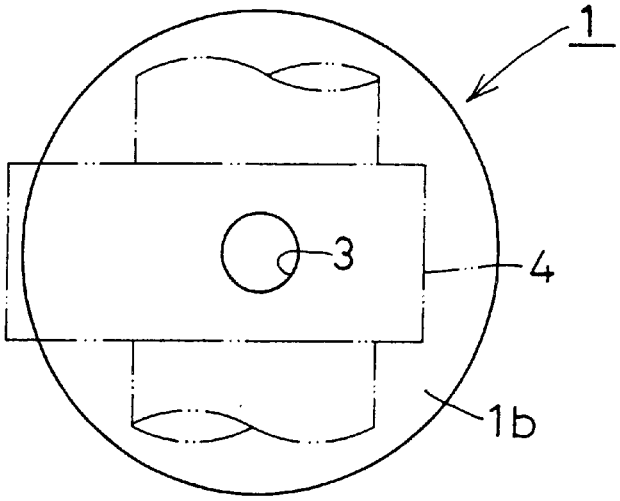
FIG. 2 is a top plan view of FIG. 1.

FIGS. 1 and 2 show the first embodiment of the present invention. A tappet 1 comprises a cylindrical portion 1*a* and a top wall 1*b* which has a cylindrical projection 2 in the middle of the lower surface. The projection has a recess for storing lubricating oil or an oil reservoir 3.

The tappet 1 is integrally molded by sheet metal pressing or deep drawing from a steel plate which has thickness of 0.5 to 2.5 mm such as cold rolling steel plate. As shown in FIG. 2, the internal diameter of the oil reservoir 3 is smaller than width of a cam 4 which is slidably engaged on the upper surface of the top wall 1*b* so that the cam 4 may not fall into the oil reservoir 3.

The lower surface of the projection 2 is engaged on the upper end of a poppet valve 5 which moves up and down. Thus, the length of the projection 2 is suitably determined at the step of pressing so that valve clearance may be kept at optimum without shim or chip for adjusting valve clearance.

The tappet may be hardened by carburizing to increase wear resistance and strength.

In the first embodiment of the tappet 1, lubricating oil 6 collected in the oil reservoir 3 overflows when the tappet 1 is pressed down by the cam 4 to scatter onto the upper surface of the top wall 1*b*.

When the tappet 1 rises, the lubricating oil 6 on the inner wall of a bore of a cylinder head is collected to the oil reservoir 3 and kept therein.

The tappet 1 moves up and down, and sufficient lubricating oil exists on the upper surface of the top wall 1*b* so that interface between the top wall 1*b* and the cam 4 may be effectively lubricated. Therefore, frictional or wear resistance between them are decreased.

Figure 3:
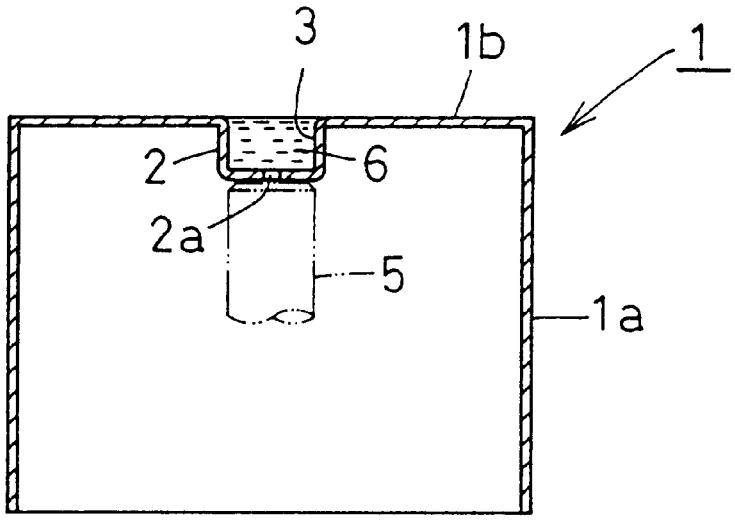
FIG. 3 is a central vertical sectional front view of the second embodiment of a tappet according to the present invention.

FIG. 3 illustrates the second embodiment of the present invention, in which a bore 2*a* which has smaller diameter is formed on the bottom of a projection 2 of a tappet 1. Thus, lubricating oil 6 in an oil reservoir 3 is partially flowed into the interface between a poppet valve 5 and the projection 2 through the bore 2*a* to lubricate it to decrease wear.

Figure 4:
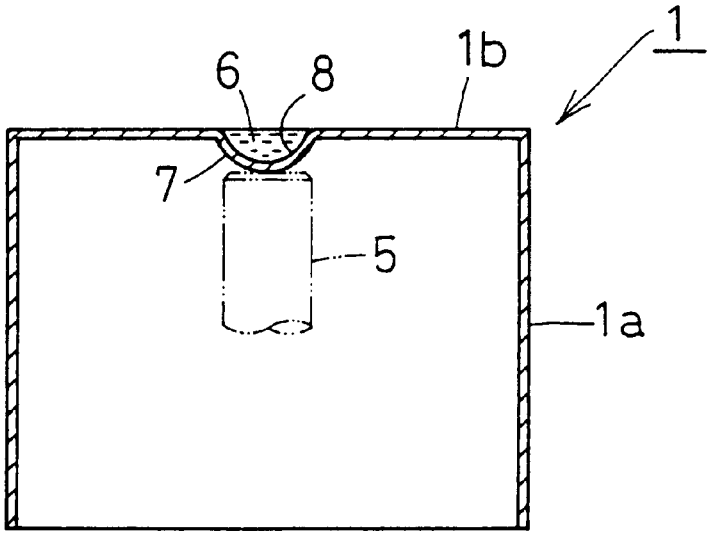
FIG. 4 is a central vertical sectional front view of the third embodiment of a tappet according to the present invention.

FIG. 4 shows the third embodiment of the present invention, in which a semi-spherical projection 7 is formed in a top wall 1*b*, and the upper surface thereof is used as an oil-storage recess or an oil reservoir 8. The upper end of a poppet valve 5 is engaged on the lower surface of the projection 7.

The oil reservoir 8 achieves similar advantages to the foregoing embodiments. The semi-spherical projection 7 stores oil less than the cylindrical projection in the first and second embodiments, so that oil is likely to overflow. Thus, it is preferable to apply it to an upright valve-operating mechanism in which an axis of a tappet is substantially vertical. In the embodiment, a bore may be formed on the bottom of the projection 7 similar to the second embodiment.

Figure 5:
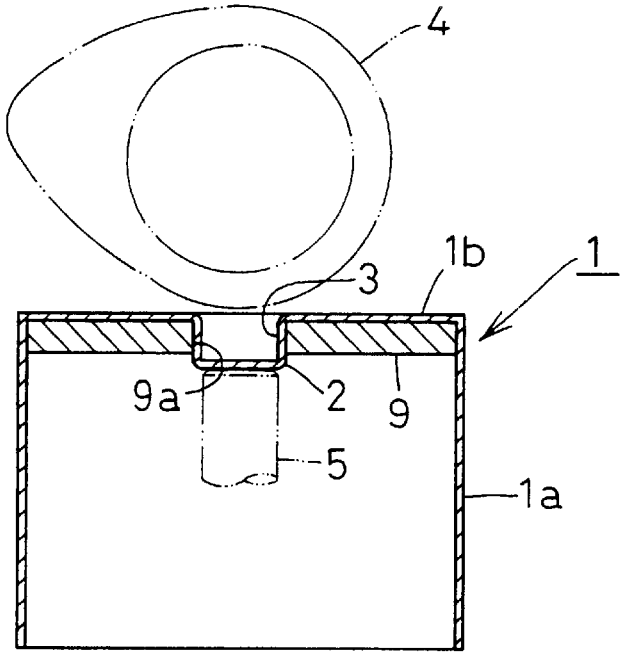
FIG. 5 is a central vertical sectional front view of the fourth embodiment of a tappet according to the present invention.

FIG. 5 shows the fourth embodiment of the present invention, in which a reinforcement disc 9 made of light alloy such as Al alloy is press-fit into a cylinder 1*a* of a tappet, and a hole 9*a* of the disc 9 is press-fit around the outer circumferential surface of the projection 2, so that the disc 9 is fitted on the lower surface of a top wall 1*b*.

The thickness of the reinforcement disc 9 is a little smaller than the height of the projection 2. The reinforcement disc 9 increases weight of the tappet 1 and vastly increases strength of the top wall 1*b* and projection 2 to improve rigidity of the tappet 1.

Figure 6:
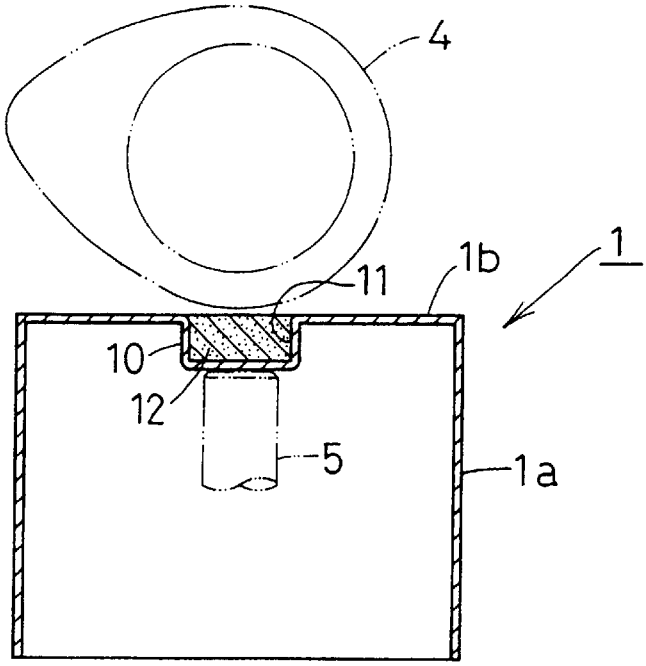
FIG. 6 is a central vertical sectional front view of the fifth embodiment of a tappet according to the present invention.

FIG. 6 is the fifth embodiment of the present invention, in which a cylindrical projection 10 which is slightly larger than the projection 2 in the above embodiments, and a wear-resistant sintered metal chip 12 is press-fit into a recess 11 of the projection 10 so that the upper surface of the chip 12 is coplanar with the upper surface of a top wall 1*b*. The upper end of a poppet valve 5 is engaged on the lower surface of the projection 10.

The chip 12 made of sintered metal is engaged in the middle of the upper surface of the top wall 1*b*. The chip 12 is porous and an enormous number of bores are impregnated with lubricating oil to increase oil-storage properties, so that frictional resistance between the top wall 1*b* and the cam 4 can be decreased similar to the foregoing embodiments. The chip 12 provides reinforcement to increase strength of the top wall 1*b*. The upper surface of the top wall 1*b* is coplanar with the upper surface of the chip 12 to keep smooth rotation of the cam 4. The width of the cam 4 can be made at minimum to increase flexibility in design.

Figure 7:
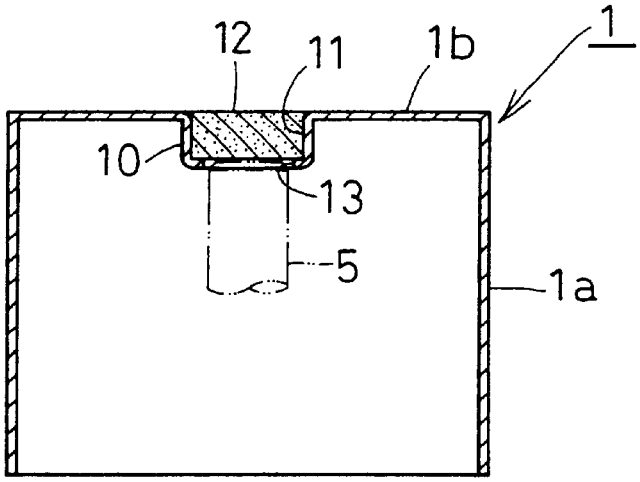
FIG. 7 is a central vertical sectional front view of the sixth embodiment of a tappet according to the present invention.

FIG. 7 shows the sixth embodiment of the present invention, in which a circular opening 13 is formed in the bottom of a projection 10 of a tappet 1. Thus, the upper end of a poppet valve 5 is engaged with the lower surface of a chip 12 through the opening 13.

Accordingly, the upper end face of the poppet valve 5 is effectively lubricated by the chip 12 which contains oil, thereby decreasing wear at the portion. Load of the cam 4 is directly applied onto the poppet valve 5 via the chip 12 through the opening 13 and is not so applied to the tappet 1 to improve durability of the tappet.

Figure 8:
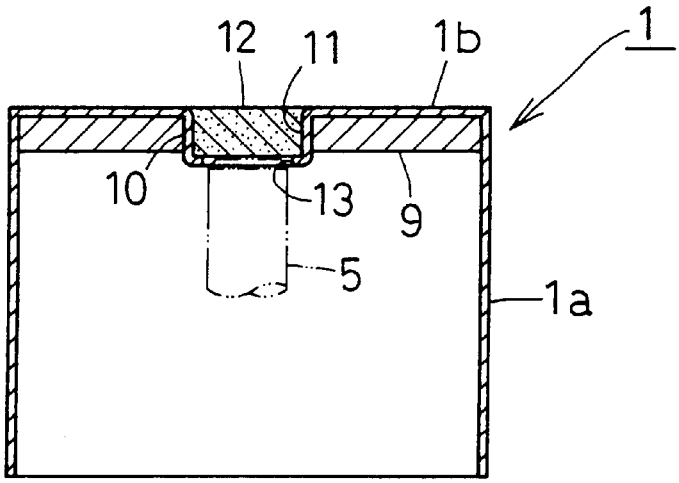
FIG. 8 is a central vertical sectional front view of the seventh embodiment of a tappet according to the present invention.

FIG. 8 shows the seventh embodiment of the present invention, in which a reinforcement disc 9 similar to that in FIG. 4 is press-fit into the inner circumferential surface in a cylindrical portion 1*a* of a tappet similar to that in FIG. 6. By press-fit of the reinforcement disc 9 in addition to a chip 12, bending strength is significantly increased.

The reinforcement disc 9 may be press-fit into the tappet 1 as shown in FIG. 5, and its illustration is omitted.

The above tappet is integrally formed by a plate. If a top wall 1*b* is thickened by another die, oil or chip storage may be formed on the upper surface of the top wall without forming a downward projection. In this case, the reinforcement disc 9 may be omitted.

The foregoing merely relate to embodiments of the present invention. Various modifications and variations may be made by person skilled in the art without departing from the scope of claims wherein:

What is claimed is:

1. A tappet for an internal combustion engine, comprising:

a cylinder bore of the internal combustion engine having a poppet valve and a cam;

a cylindrical portion into which the poppet valve is inserted;

a top wall enclosing the cylindrical portion which is engaged with the cam;

a downward projection formed in the middle of a lower surface of the top wall and having an oil-storage recess on an upper surface, the diameter of the projection being smaller than the width of the cam;

a porous metal chip fit in the recess of the downward projection such that an upper surface of the chip is coplanar with the upper surface of the top wall, the chip being impregnated with lubricating oil to decrease frictional resistance between the top wall and the cam; and an opening formed in a bottom of the downward projection so that an upper end of the poppet valve may be directly engaged with a lower surface of the chip through the opening, thereby lubricating an interface between the upper end of the poppet valve and the lower surface of the chip to decrease wear thereon.

2. A tappet as claimed in claim 1 wherein a reinforcement disc is press-fit on an outer circumferential surface of the projection to fit the lower surface of the top wall.

* * * * *